US006863550B2

(12) United States Patent
Davis et al.

(10) Patent No.: US 6,863,550 B2
(45) Date of Patent: Mar. 8, 2005

(54) SELF EJECTING COVER

(75) Inventors: David R. Davis, Jefferson, SD (US); Vernon D. Erickson, Dakota Dunes, SD (US); Richard A. Gibson, El Paso, TX (US)

(73) Assignee: Gateway, Inc., Irvine, CA (US)

( * ) Notice: Subject to any disclaimer, the term of this patent is extended or adjusted under 35 U.S.C. 154(b) by 0 days.

(21) Appl. No.: 10/447,653

(22) Filed: May 29, 2003

(65) Prior Publication Data

US 2004/0242038 A1 Dec. 2, 2004

(51) Int. Cl.[7] ..... H01R 13/44
(52) U.S. Cl. ..... 439/137; 361/683; 439/134
(58) Field of Search ..... 439/134–138, 439/148; 361/683

(56) References Cited

U.S. PATENT DOCUMENTS 3,846,576 A * 11/1974 Silbermann ..... 174/67
4,717,358 A * 1/1988 Chaundy ..... 439/557
4,828,510 A 5/1989 Muzslay ..... 439/352
5,637,002 A 6/1997 Buck et al. ..... 439/148
6,030,242 A 2/2000 Cunningham et al. ..... 439/237
6,123,557 A 9/2000 Wang et al. ..... 439/137
6,711,008 B2 * 3/2004 Teng et al. ..... 361/683
2004/0008480 A1 * 1/2004 Kim ..... 361/683

* cited by examiner

*Primary Examiner*—Tho D. Ta
(74) *Attorney, Agent, or Firm*—Nathan T. Grebasch; Suiter-West

(57) ABSTRACT

The present invention is directed to a system and method for providing a self-ejecting cover for externally accessible electronic components. The system of the present invention includes a panel with an aperture for accepting an externally accessible component such as a communication connection. A self-ejecting cover with an engaging tab is disposed in the aperture. Upon connecting the panel to a device with a corresponding component the cover is ejected, if an external component is not included the cover remains in place.

33 Claims, 5 Drawing Sheets

SELF EJECTING COVER

FIELD OF THE INVENTION

The present invention generally relates to the field electronics and particularly to a self ejecting cover.

BACKGROUND OF THE INVENTION

Electronic manufacturers and in particular computer manufacturers typically allow semi-customization of a device to a customer's specifications. Semi-customization permits the customer to select from various components, communication connections, and the like. Manufacturing semi-customized devices may be problematic especially when a device extends beyond the cover or access is required. For instance, a communication connection, included in a computer, is required to be externally accessible, thus an aperture must be included in the cover. Correspondingly, if a communication connection is omitted a cover is required to protect the computer from dust, debris and the like. Moreover, a housings system is required to minimize the ingress of dust and debris, users from contacting internal electronics, proper magnetic/electric shielding, and the like.

Previously, covers for externally accessible components were removed during manufacturing utilizing a hand-tool or specialized device. For instance, a worker would remove an access cover using a screw driver. In the case of a retrofit, a user may not possess the required tool, removing the cover may be difficult, or time consuming. During manufacturing, additional personnel or machinery may be required to selectively remove unnecessary access covers.

Therefore, it would be desirable to provide a self-ejecting access cover and a method for manufacturing electronic devices without the need to utilize a tool to remove access covers.

SUMMARY OF THE INVENTION

Accordingly, the present invention is directed to a system and method for providing a self-ejecting cover for electronic devices. The system of the present invention allows covers for externally accessible components to automatically eject upon connection with an external component.

In an aspect of the present invention, a system includes a panel for partially enclosing an electronic device such as a computer. An aperture or series of apertures for externally accessible components are included in the panel. A cover is secured in the aperture via an engaging tab. The engaging tab extends substantially perpendicular from a major surface of the cover. The engaging tab automatically extracts the cover away from the electronic device upon contact between the cover/tab and the externally accessible component. Moreover, when an electronic device does not include an externally accessible component a corresponding cover may remain in place to protect internal electronics.

In a further aspect, a method for manufacturing an electronic device is disclosed. An electronic device such as a computer is configured including a configuration of externally accessible components. The configured device is mated to a panel including an ejecting cover. A cover is ejected in response to contact between the cover and an included externally accessible component contacting while mating the panel and electronic device.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 4, exemplary embodiments of the present invention are shown wherein a system and method for providing a self-ejecting cover for externally accessible components included in an electronic device is disclosed. The system and method of the present invention permit tool-less cover removal for external components, thus allowing efficient manufacture and easy retrofitting.

Figure 1:
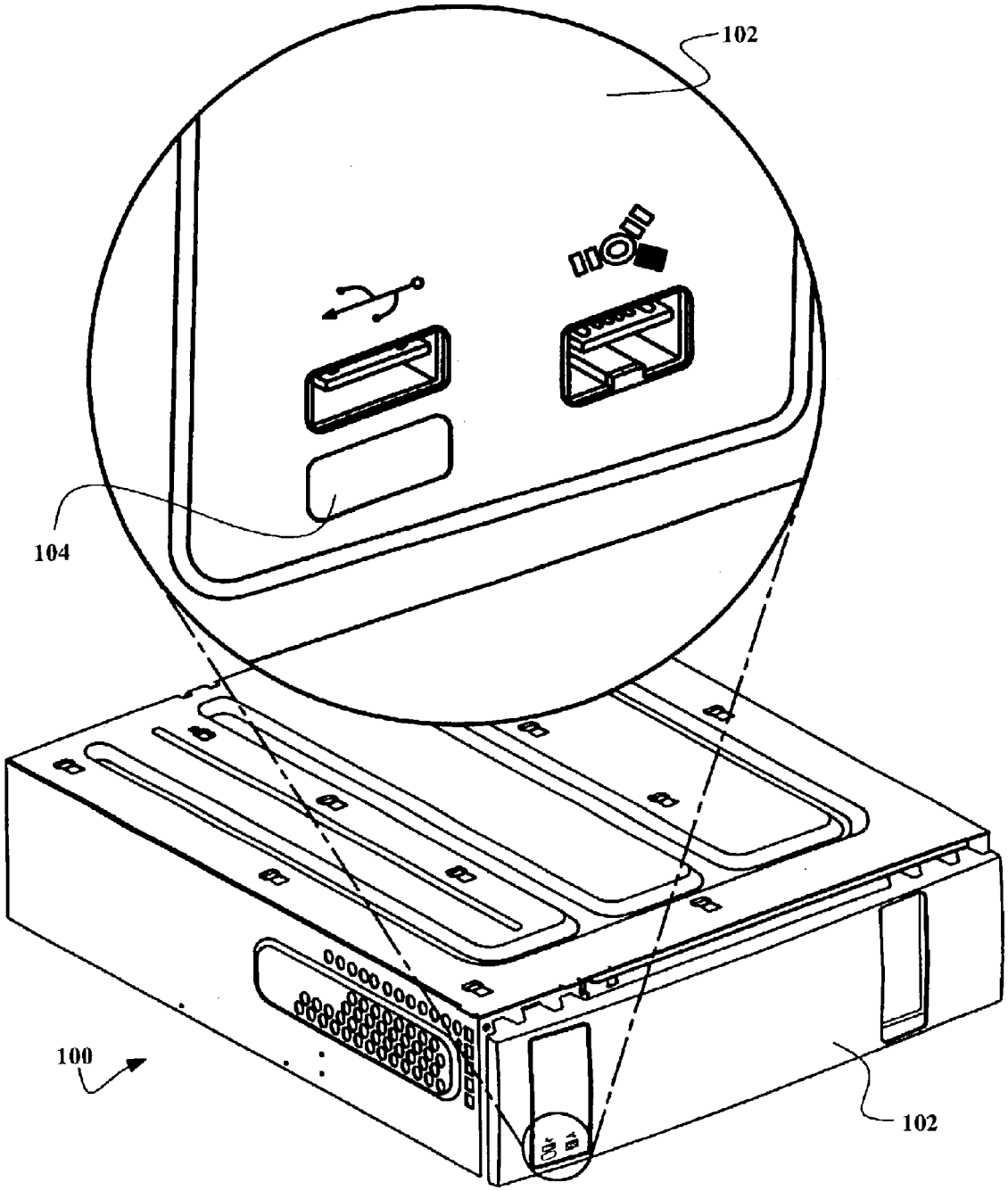
FIG. 1 is a perspective view of a computer chassis including a panel with a self-ejecting cover.

Referring to FIG. 1, a system 100 including an self-ejecting cover is shown. The system 100 is implemented with a computer in the current embodiment. In further embodiments, the self-ejecting cover system is utilized with other electronic devices and the like.

The system 100 includes a panel 102. For example, panel is a computer bezel cover. The panel 102 may be formed of plastic, metal, composite material and the like as desired to protect the electronic device from dust, debris, electrical/magnetic interference and the like.

Included in the panel 102 is an aperture 104 for accepting an externally accessible component. The panel 102 may include a plurality of apertures of varying size and shape to permit semi-customization. For instance, electronic devices, and in particular computers, include components which a user will routinely access. Communication connectors, such as Universal Serial Bus (USB) plugs, IEEE 1394 High Performance Serial Bus sold under the trademark Firewire, connectors, audio connectors, and the like often require user access. For example, a computer user may wish to download digital images via a Firewire connection included on the front of their computer. Additionally, removable media components such as floppy drives, DVD drives, CD-ROM drives require access to change media.

Figure 2:
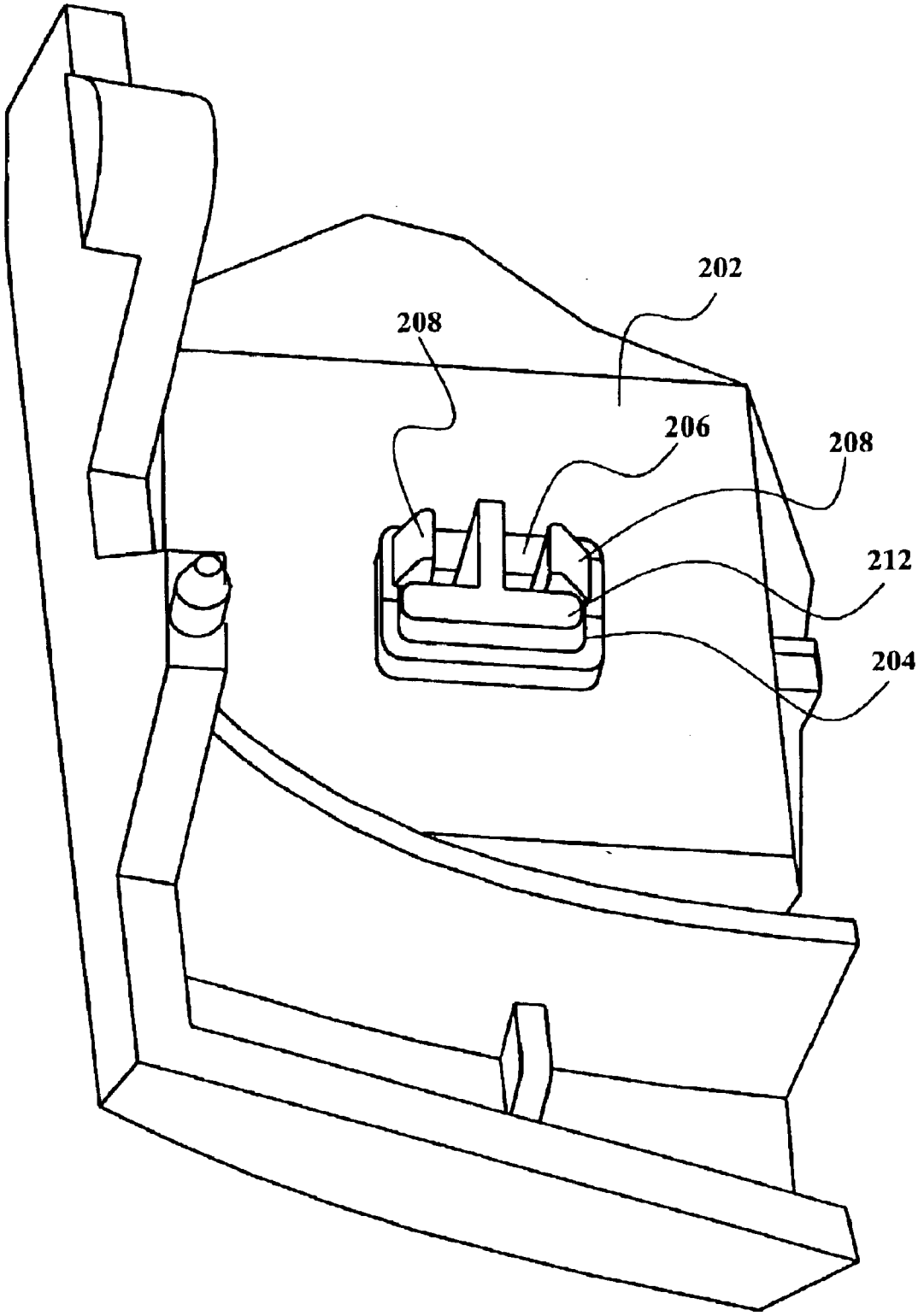
FIG. 2 is a perspective view of a panel including a self ejecting cover.

Referring to FIG. 2, a cover 206 substantially matching the aperture 204 is included in a panel 202. An engaging tab extends from the cover 206. For instance, the engaging tab is directed towards the enclosed electronic device. Suitable engaging tabs include wedge locks, friction locks, bayonet locks, and the like, configured to removably secure a cover to the panel. That is, the engaging tabs are removably secured within the aperture 204 of the panel 202 in the sense that the engaging tabs may be removed without damaging the aperature 202 or an external component (e.g., USB plug 310 of FIG. 3) of the enclosed electronic device. In the illustrated exemplary embodiment of FIG. 2 two wedge locks 208 are shown as engaging tabs. The wedge locks 208 extend from the cover surface to engage an extension on the panel 202. For example, the wedge locks may be co-molded with the cover, sonic welded to the cover and the like. Engaging tabs allow secure retention of the cover when a corresponding component is not included. For instance, if a customer does not select an external communication connections, the cover is retained in the aperture to prevent the ingress of dust, debris and the like.

Figure 3A:
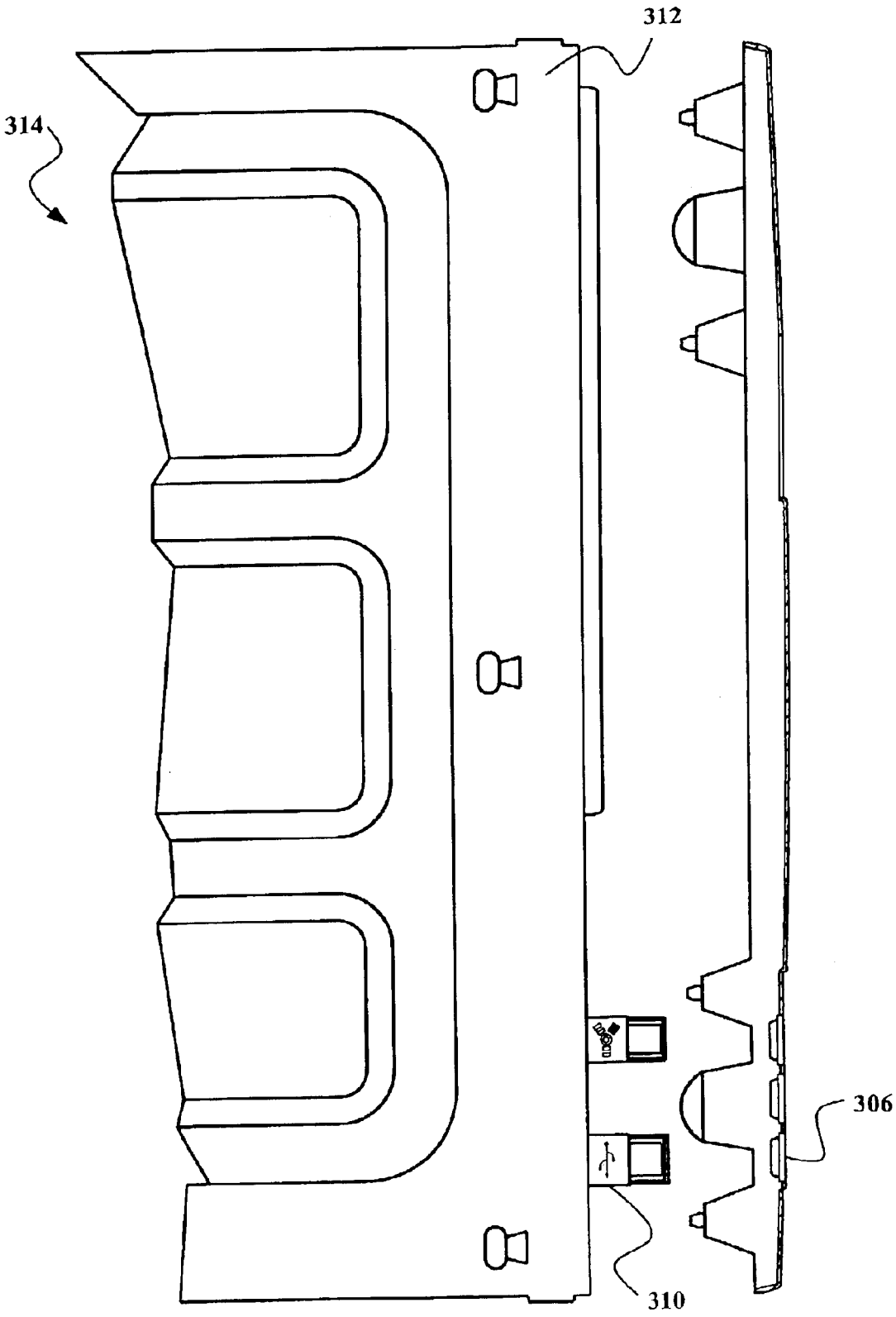
FIG. 3A is a side view of a panel including a self-ejecting cover prior to mating to a computer including a USB plug.
Figure 3B:
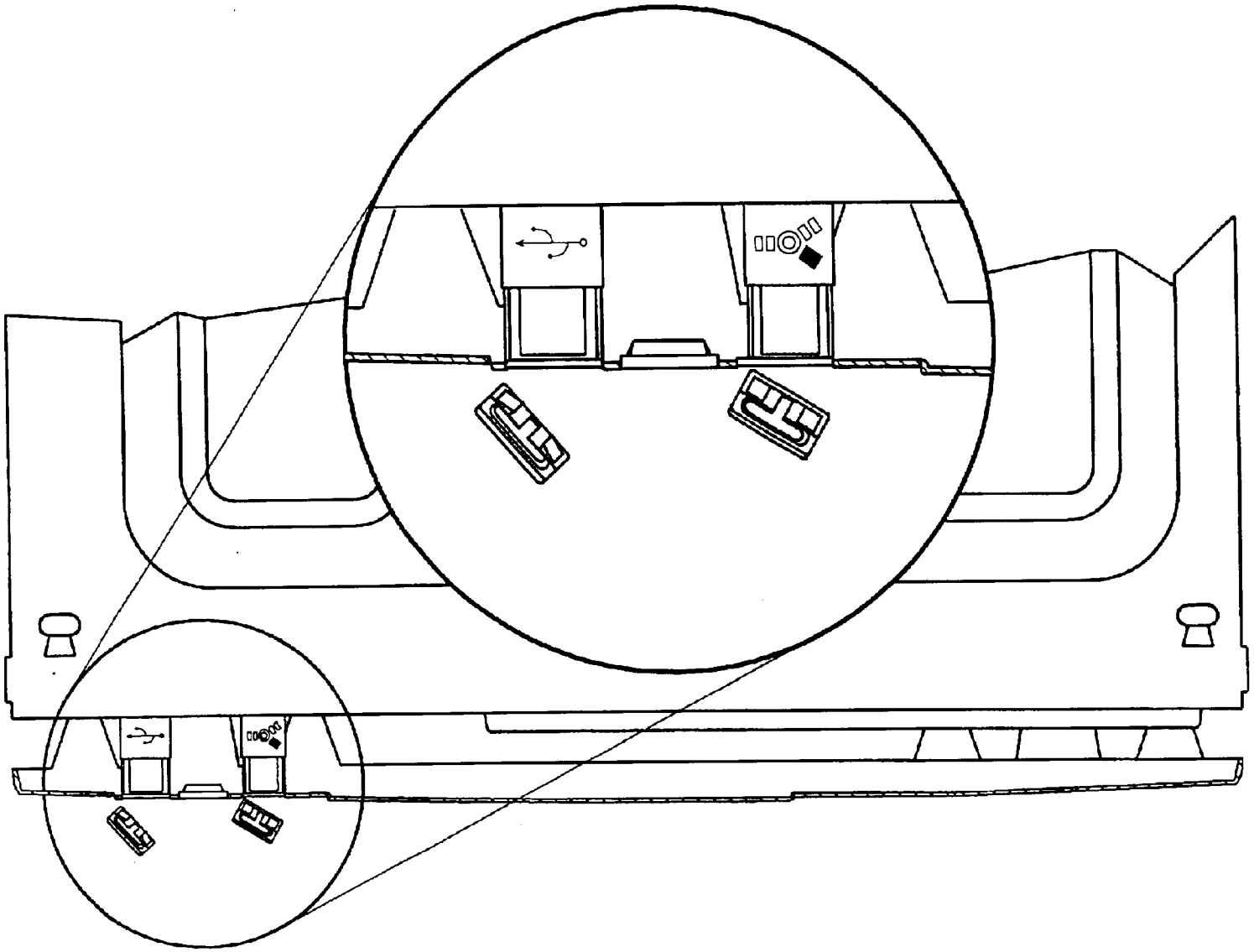
FIG. 3B is a side view of the panel and computer of FIG. 3A upon coupling.

Referring to FIGS. 3A and 3B, when an electronic device 314 is configured with an external component such as a USB plug 310, the plug contacts the cover 306 upon connection. For instance, during computer manufacturing the panel including the self-ejecting cover is aligned with, and connected to, a main chassis 312 including internal electronics and the USB plug 310. As a result of contact between the plug 310 and cover 306, the cover 306 may be automatically ejected. That is, the cover 306 is automatically ejected from the aperture in response to the cover 306 coming into contact with the plug 310 as the panel is connected to the main chassis 312. See generally FIG. 3B. For instance, during connection the externally accessible component may cause the engaging tab to release. A wedge lock with an angled portion directed towards the component may release due to the wedge portion being forced away from the side of the aperture. Self-ejecting covers may reduce manufacturing cost because workers do not have to manually remove covers.

Referring again to FIG. 2, in further embodiments, a self-ejecting cover 206 includes a contact structure 212. In the present example, the contact structure is T-shaped and extends parallel with the engaging tabs from a main surface of the cover. Contact structures allow the force of the contact between the externally accessible component and the cover 206 to be distributed substantially across the cover, so the contact force directs the cover outward, away from the panel, thus, preventing the cover from becoming caught in the aperture. Additionally, utilizing a contact structure may minimize accidental breakage of the engaging tabs, damage to the externally accessible component and the like.

Figure 4:
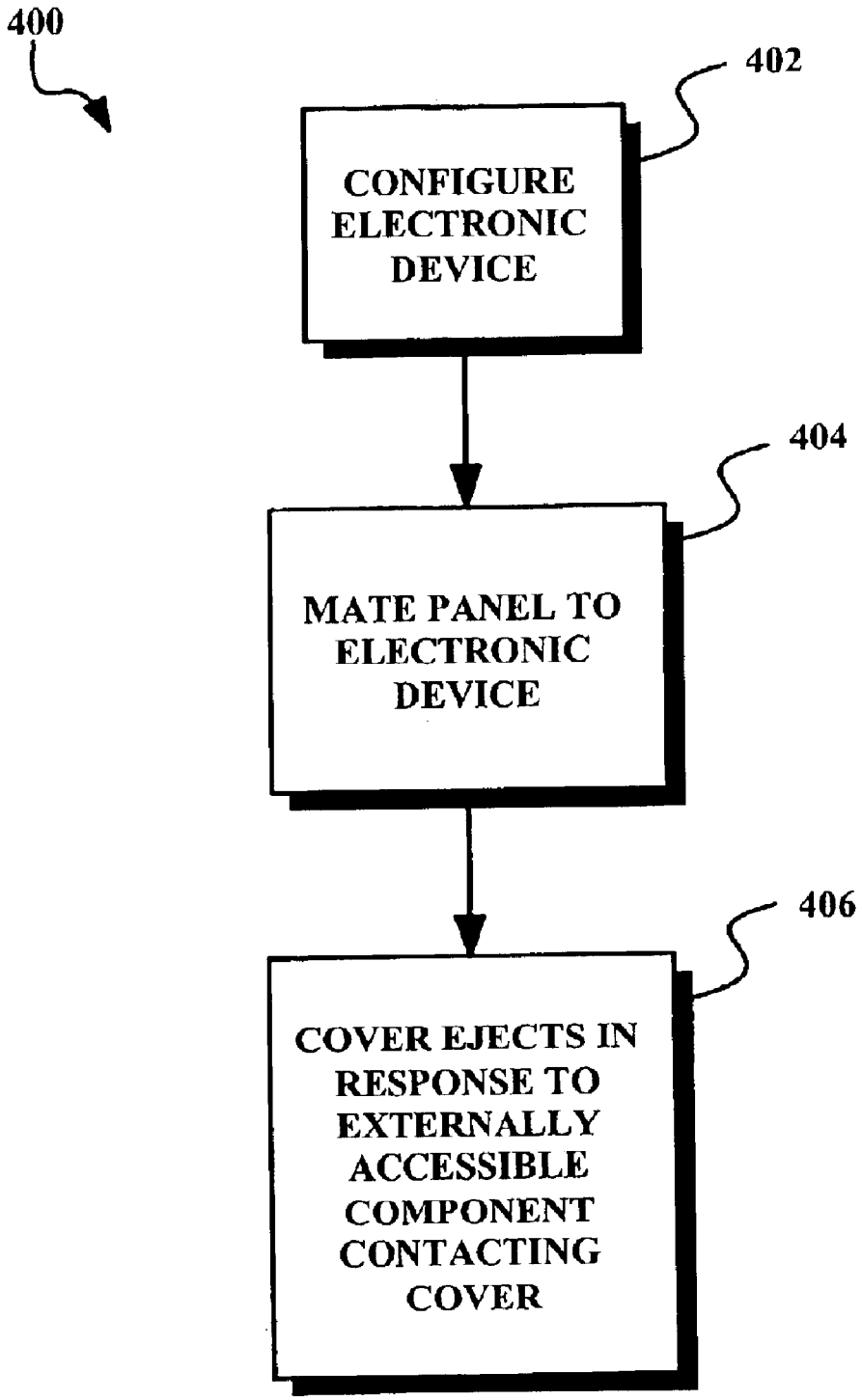
FIG. 4 is a flow chart illustrating a method for manufacturing an electronic device.

Referring to FIG. 4 a method 400 for manufacturing an electronic device is discussed. Initially, an electronic device is configured 402 according to the customer's request. For instance, the electronic device is assembled with a package of components matching the customers selection from a group of offered components. For example, a customer may choose to include a component which requires external access such as a USB plug.

Once the device is configured, the device is mated 404 with a panel including self-ejecting covers disposed in panel apertures. Mating may be accomplished by forcing the panel and the electronic device together. For instance, the panel may include apertures and covers for two USB connections and a Firewire connection. If the purchaser has decided that they wish to only include one USB connection and a Firewire connection, upon mating 404 the covers corresponding to the included USB and Firewire connection are ejected 406, while one USB cover, corresponding to a potential USB connection remains in place. Contact between an included component and the cover forces the cover generally outward, or away from the electronic device. Manufacturing an electronic device in this manner allows semi-customization without the need for additional personnel to remove unnecessary covers.

Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented It is believed that the apparatus and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A system, comprising:

a panel for at least partially enclosing an electronic device, said panel including an aperture therein configured to accept an externally accessible component included in the electronic device; and a cover at least partially engaging the panel, said cover disposed in the aperture;

wherein the cover is configured to automatically extract upon contacting the externally accessible component.

2. The system of claim 1, further comprising a contact structure extending from the cover.

3. The system of claim 1, wherein the externally accessible component is a communication connector.

4. The system of claim 1, wherein the aperture is configured to accept at least one of a universal serial bus connector, an IEEE 1394 High Performance Serial Bus connector, and a audio connector.

5. The system of claim 1, wherein the aperture is configured to accept a removable media drive.

6. The system of claim 1, wherein the panel is a computer bezel cover.

7. The system of claim 1, wherein the cover further includes an engaging tab.

8. A self-ejecting computer cover configured for tool-less assembly, comprising:

a panel for at least partially enclosing a computer, said panel including an aperture therein configured for accepting an externally accessible component included in the computer; and a self-extracting cover configured to be disposed in the aperture, including:

an engaging tab extending from a first surface of the cover, for at least partially engaging the panel;

wherein the self-extracting cover is configured to automatically extract upon contacting the externally accessible component.

9. The self-ejecting computer cover configured for tool-less assembly of claim 8, further comprising a contact structure extending from the self-extracting cover parallel with the engaging tab.

10. The self-ejecting computer cover configured for tool-less assembly of claim 8, wherein the aperture is configured to accept at least one of a universal serial bus connector, an IEEE 1394 High Performance Serial Bus connector, and a audio connector.

11. The self-ejecting computer cover configured for tool-less assembly of claim 8, wherein the aperture is configured to accept a removable media drive.

12. The self ejecting computer cover configured for tool-less assembly of claim 8, wherein the panel is a computer bezel cover.

13. The self-ejecting computer cover configured for tool-less assembly of claim 8, wherein the engaging tab is at least one of a wedge lock, a friction lock, and a bayonet lock.

14. A self-ejecting electronic device cover system, comprising:

a panel for at least partially enclosing an electronic device, said electronic device optionally including an externally accessible component, said panel including an aperture therein configured to accept an included externally accessible component; and a cover disposed in the aperture, including:

an engaging tab extending from a first surface of the cover, for at least partially engaging the panel;

wherein the cover is configured to automatically extract upon contacting an included externally accessible component.

15. The self-ejecting electronic device cover system of claim 14, further comprising a contact structure extending from the cover parallel with the engaging tab.

16. The self-ejecting electronic device cover system of claim 14, wherein a externally accessible component is a communication connector.

17. The self-ejecting electronic device cover system of claim 14, wherein the aperture is configured to accept at least one of a universal serial bus connector, an IEEE 1394 High Performance Serial Bus connector, and a audio connector.

18. The self-ejecting electronic device cover system of claim 14, wherein the panel is a computer bezel cover.

19. The self-ejecting electronic device cover system of claim 14, wherein the engaging tab is at least one of a wedge lock, a friction lock, and a bayonet lock.

20. A system, comprising:

a panel for at least partially enclosing an electronic device, including an aperture therein configured for accepting an externally accessible component; and a self-extracting cover disposed in the aperture, including: means for releasably engaging the panel; connected to the self-extracting cover;

wherein the engaging means automatically extracts the self-extracting cover upon contacting the externally accessible component included in the electronic device.

21. The system of claim 20, further comprising a contact structure extending from the self-extracting cover parallel with the engaging means.

22. The system of claim 20, wherein the aperture is configured to accept at least one of a universal serial bus connector, an IEEE 1394 High Performance Serial Bus connector, and a audio connector.

23. The system of claim 20, wherein the aperture is configured to accept a removable media drive.

24. The system of claim 20, wherein the panel is a computer case bezel cover.

25. The system of claim 20, wherein the engaging means is at least one of a wedge lock, a friction lock, and a bayonet lock.

26. A method for manufacturing an electronic device, comprising:

configuring an electronic device including at least one externally accessible component;

mating the configured electronic device to a panel for at least partially enclosing the electronic device; and ejecting a cover, included in the panel, aligned with the at least one included component in response to the mating of the electronic device to the panel.

27. The method for manufacturing an electronic device of claim 26, wherein the electronic device is a computer.

28. The method for manufacturing an electronic device of claim 26, wherein in the panel is a bezel cover.

29. A method for manufacturing an electronic device, comprising:

configuring an electronic device including at least one externally accessible component;

mating the configured electronic device to a panel for at least partially enclosing the electronic device; and ejecting a cover, included in the panel, aligned with the at least one included component in response to the mating of the electronic device to the panel, wherein mating the electronic device and the panel causes the at least one externally accessible component to contact an engaging tab included on the cover.

30. A method for manufacturing an electronic device, comprising:

configuring an electronic device optionally including an externally accessible component; and mating the electronic device to a panel including a self-ejecting cover, whereby, the self-ejecting cover is ejected if an externally accessible component is included in the electronic device.

31. The method for manufacturing an electronic device of claim 30, wherein the electronic device is a computer.

32. The method for manufacturing an electronic device of claim 30, wherein in the panel is a bezel cover.

33. A method for manufacturing an electronic device, comprising:

configuring an electronic device optionally including an externally accessible component; and mating the electronic device to a panel including a self-ejecting cover, whereby, the self-ejecting cover is ejected if an externally accessible component is included in the electronic device, wherein mating the electronic device and the panel causes the at least one externally accessible component to contact an engaging tab included on the cover.

* * * * *